US007216609B2

(12) United States Patent
Theorell

(10) Patent No.: US 7,216,609 B2
(45) Date of Patent: May 15, 2007

(54) MOTOR VEHICLE COOLING SYSTEM

(75) Inventor: Gunnar Theorell, Lerum (SE)

(73) Assignee: Volvo Lastvagnar AB, Göteborg (SE)

( * ) Notice: Subject to any disclaimer, the term of this patent is extended or adjusted under 35 U.S.C. 154(b) by 0 days.

(21) Appl. No.: 11/379,814

(22) Filed: Apr. 24, 2006

(65) Prior Publication Data

US 2006/0213459 A1 Sep. 28, 2006

Related U.S. Application Data

(63) Continuation of application No. PCT/SE04/01509, filed on Oct. 19, 2004.

(30) Foreign Application Priority Data

Oct. 24, 2003 (SE) ..... 0302834

(51) Int. Cl.
*F01P 3/00* (2006.01)
*F01P 1/10* (2006.01)

(52) U.S. Cl. ..... 123/41.29; 123/41.31

(58) Field of Classification Search ..... 123/41.1, 123/41.29, 41.31, 41.33, 196 AB, 563
See application file for complete search history.

(56) References Cited

U.S. PATENT DOCUMENTS 3,752,132 A * 8/1973 Bentz et al. ..... 123/41.1
5,598,705 A 2/1997 Uzkan
7,047,913 B2 * 5/2006 Werner et al. ..... 123/41.33
2003/0029167 A1 2/2003 Hudson et al.

FOREIGN PATENT DOCUMENTS

DE 19854544 A1 6/2000
DE 10138704 A1 3/2003
EP 0283340 A1 9/1988
EP 0512307 A1 11/1992

OTHER PUBLICATIONS

International Search Report for corresponding International Application PCT/SE2004/001509.

* cited by examiner

*Primary Examiner*—Noah P. Kamen
(74) *Attorney, Agent, or Firm*—WRB-IP LLP

(57) ABSTRACT

A cooling system for an internal combustion engine mounted in a vehicle includes a first flow circuit with a pump for circulating coolant via ducts in the cylinder block of the engine and a radiator. The first flow circuit is separated from atmospheric pressure. The cooling system also includes a second flow circuit which is provided with a coolant reservoir with a normal pressure which is lower than the pressure in the first flow circuit, and a pump for circulating coolant via a pipeline between units with a cooling requirement and a second radiator. The second flow circuit is connected to the first flow circuit via a one-way valve opening in the direction of the first flow circuit.

20 Claims, 3 Drawing Sheets

MOTOR VEHICLE COOLING SYSTEM

BACKGROUND AND SUMMARY

The present invention is a continuation of International Application PCT/SE2004/001509, filed Oct. 19, 2004, which claims priority to SE 0302834-7, filed Oct. 19, 2003, both of which are incorporated by reference.

The present invention relates to a cooling system for an internal combustion engine mounted in a vehicle, which cooling system comprises a flow circuit with a pump for circulating coolant via ducts in the cylinder block of the engine and a radiator, which flow circuit is separated from atmospheric pressure.

In conventional cooling systems for an internal combustion engine mounted in a vehicle, use is made of a relatively large expansion tank as a reserve volume for coolant and in order to compensate for the expansion of the coolant which takes place when it is heated up from cold starting to full operating temperature, around 80–90° C. The expansion tank requires space and encroaches on the cooling area.

The development of heavy-duty, turbocharged diesel vehicles, for example trucks, has meant an increasing demand for cooling capacity for oil coolers for engine and gearbox, charge air coolers, coolers for EGR gas and coolers for retarders. Some of these devices, for example charge air coolers, EGR coolers and transmission coolers, often require a lower temperature of the coolant inflow than that required by the internal combustion engine.

This demand has usually been met by increasing radiator area and coolant flow. These measures generally mean that the risk of cavitation at the coolant pump increases because the pressure drop in these cooling systems is great.

From U.S. Pat. No. 6,532,910, for example, it is known to pressurize a cooling system via the expansion tank by means of positive pressure from the intake side of the engine. The pressure increase means that a higher temperature can be maintained in the cooling system, at the same time as the cavitation risk decreases. One problem with this known solution is that it can take several minutes from the engine being started until the pressure in the cooling system has been built up, if the engine is run at low load. During this period of time, cavitation in the cooling system circulation pump and cylinder liners can lead to local overheating which may involve engine damage. Moreover, the system pressure can disappear in the event of minor valve leakage.

It is desirable therefore to produce a cooling system which makes more rapid pressure build-up possible, which can be designed in a space-saving way and with a low pressure drop and which does not lose the system pressure in the event of moderate valve leakage.

According to an aspect of the present invention, a cooling system for an internal combustion engine mounted in a vehicle comprises a first flow circuit with a pump for circulating coolant via ducts in a cylinder block of the engine and a radiator, the flow circuit being separated from atmospheric pressure, and a second flow circuit comprising a coolant reservoir with a normal pressure which is lower than a pressure in the first flow circuit, and a pump for circulating coolant via a pipeline between units with a cooling requirement and a second radiator, wherein the second flow circuit is connected to the first flow circuit via a one-way valve opening in a direction of the first flow circuit.

This design of the cooling system can allow the two flow circuits to be optimized individually for different tasks/temperature ranges with advantageous flow resistance. The flow circuit operating with a higher temperature range can be designed to be closed to the atmosphere, so that the pressure build-up in this circuit can take place rapidly. Normal pressure means the pressure which normally arises in the second flow circuit when the engine operates.

BRIEF DESCRIPTION OF FIGURES

The invention will be described in greater detail below with reference to illustrative embodiments shown in the accompanying drawings, in which.

DETAILED DESCRIPTION

The cooling system according to the invention will be described in connection with FIGS. 1 and 2 as two separate flow circuits, which are shown combined in FIG. 3.

Figure 1:
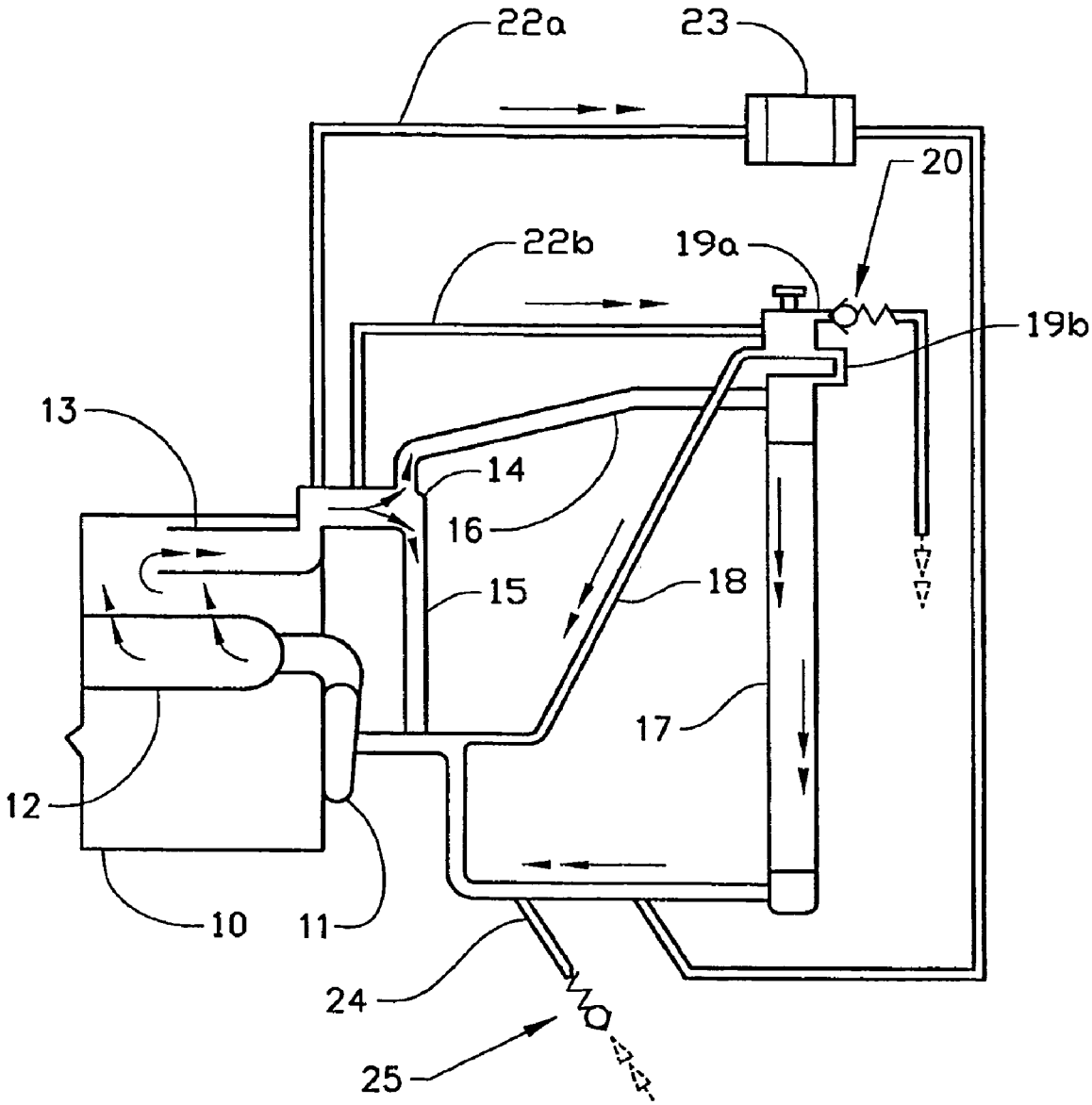
FIG. 1 is a diagrammatic sketch which shows a first flow circuit in a cooling system according to the invention.

The main task of the first flow circuit shown in FIG. 1 is to regulate the temperature of an internal combustion engine 10. For this purpose, the flow circuit comprises a circulation pump 11 which on the pressure side feeds coolant in through ducts in the cylinder block of the engine 10 for cooling cylinder liners and cylinder head. The coolant also passes through an oil cooler 12 and an EGR cooler 13 arranged in conjunction with the cylinder head.

The coolant leaves the cylinder head via a thermostat valve 14 which can in a known way conduct the flow either, at low temperature, via a return line 15 directly back to the inlet of the pump 11 or, at higher temperatures, via the pipeline 16 through a radiator 17. This is connected to the suction side of the pump, which is also connected via a pipeline 18 to a filling/venting vessel 19*a*, which is connected to the radiator 17 via a pipeline 19*b* and is provided with a pressure-tolerant filling cover and a pressure control valve 20. An outlet from this valve 20 is connected to a coolant reservoir 21 shown in FIGS. 2 and 3. A pipeline 22*a* extends from a point upstream of the thermostat valve 14, via a heater 23 for heating the cab of the vehicle, to a point downstream of the radiator 17. A venting line 22*b* extends from the same part of the circuit to the filling/venting vessel 19*a*. A further branch line 24 forms a connection to the second flow circuit, which connection is limited by means of a compression-spring-loaded non-return valve 25. This first flow circuit is therefore separated from atmospheric pressure by means of the pressure control valve 20 and the non-return valve 25.

Figure 2:
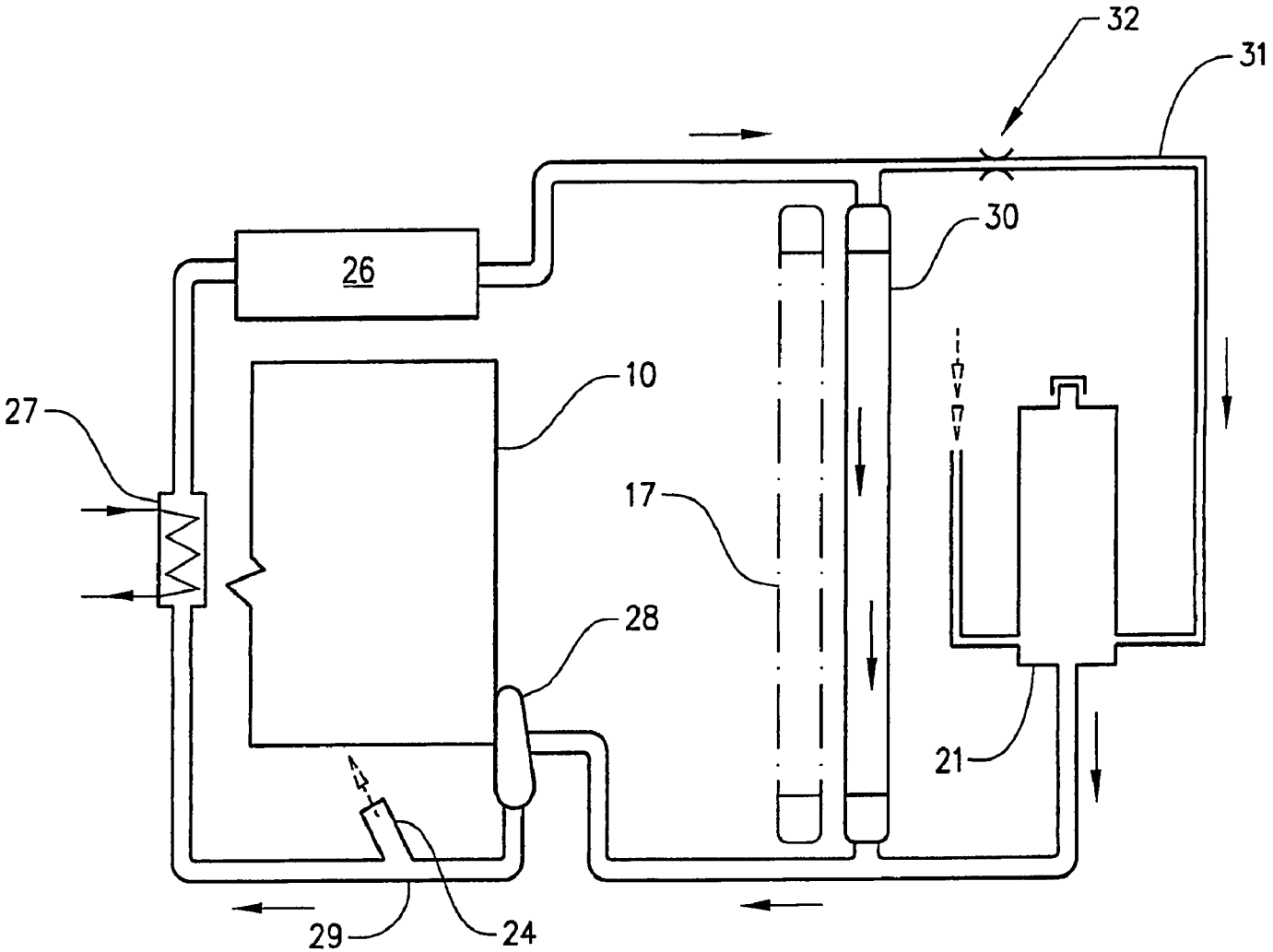
FIG. 2 shows in a corresponding way a second flow circuit in the cooling system according to the invention.

The main task of the second flow circuit shown in FIG. 2 is to regulate the temperature of one or more heat exchanger (s) 26 for charge air and EGR and also for gearbox cooling 27. For this purpose, the flow circuit comprises a circulation pump 28 which on the pressure side feeds coolant through a pipeline 29. After passing through the heat exchanger(s) mentioned above, the coolant is cooled by means of a radiator 30 which is positioned upstream of the radiator 17 in relation to an air flow which passes these radiators. A branch line 31 for venting is connected to the pipeline 29 upstream of the radiator 30 and connects the latter to the coolant reservoir 21 via a choke 32. The branch line 24 is connected to the pipeline 29 of the second flow circuit on the pressure side of the circulation pump 28. This second flow circuit suitably operates with a lower temperature and a lower pressure than the first flow circuit.

Figure 3:
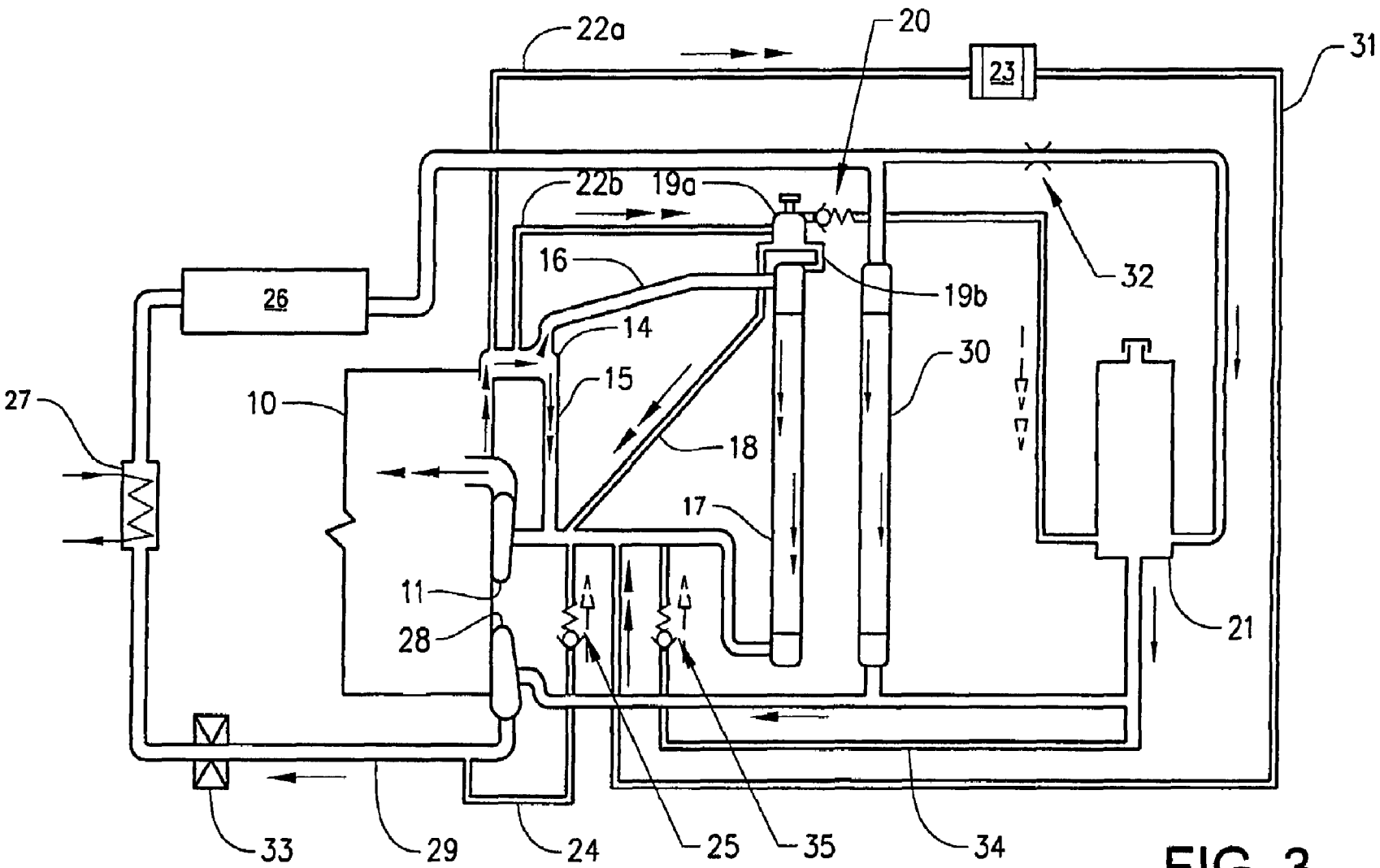
FIG. 3 shows in a corresponding way the two flow circuits combined so as to show the cooling system according to the invention in its entirety.

FIG. 3 shows the two flow circuits combined to form the cooling system according to the invention. By dividing the cooling system into two separate flow circuits, the pressure drop can be kept low. When the engine is started, the first flow circuit is pressurized with coolant which is fed from the coolant reservoir 21 to the suction side of the circulation pump 11 with the aid of the circulation pump 28 and the branch line 24. During pressure build-up, venting of the cooling system takes place to the coolant reservoir 21 via the pressure control valve 20 in the first circuit and the choke 32 in the second circuit. On cooling, coolant can be drawn from the tank 21 to the first flow circuit via the non-return valve 25 and the branch line 24.

FIG. 3 shows a variant of the invention where the second flow circuit has been provided with a variable choke 33 downstream of the branch line 24 and upstream of the heat exchanger 27. This choke 33 can be used actively in order to increase the pressure drop in the second flow circuit momentarily when the engine is started, which speeds up the pressure build-up in the first flow circuit and thus reduces the risk of cavitation damage. Moreover, the choke can be used in order to feed coolant from the second flow circuit (the low temperature circuit) to the first flow circuit (the high temperature circuit) in order to increase the cooling performance momentarily, for example in the case of retarder braking. In this connection, coolant with a lower temperature is fed to the first flow circuit through the non-return valve 25, and a corresponding quantity of coolant is fed out through the pressure valve 20 to the coolant reservoir 21.

A further variant of the invention is shown in FIG. 3. In the event of a large pressure drop over the second flow circuit, the feed pressure from this circuit to the first flow circuit may become too high. In this connection, the feed pressure can be limited by the reducing valve 25. According to FIG. 3, the cooling system has a line with a non-return valve 35 which makes it possible for coolant to flow into the first flow circuit from the coolant reservoir 21 when the cooling system undergoes cooling.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

The invention is not to be regarded as being limited to the illustrative embodiments described above, but a number of further variants and modifications are conceivable within the scope of the patent claims which follow. For example, the filling/venting vessel 19*a* can be combined with the radiator 17. The pressure control valve 20 does not have to be integrated with the filling/venting vessel 19*a* but can instead be positioned at the inlet to the coolant reservoir 21 or on the line between the latter and the vessel 19*a*. Various components with a cooling requirement, for example an EGR cooler and an oil cooler, can be connected optionally to one or other flow circuit according to requirement and optimization and are therefore not tied to the illustrative embodiment shown.

The invention claimed is:

1. A cooling system for an internal combustion engine mounted in a vehicle, comprising:

a first flow circuit with a pump for circulating coolant via ducts in a cylinder block of the engine and a radiator, the flow circuit being separated from atmospheric pressure; and a second flow circuit comprising a coolant reservoir with a normal pressure which is lower than a pressure in the first flow circuit, and a pump for circulating coolant via a pipeline between units with a cooling requirement and a second radiator, wherein the second flow circuit is connected to the first flow circuit via a one-way valve opening in a direction of the first flow circuit.

2. The cooling system as claimed in claim 1, wherein the one-way valve is positioned in a pipeline which connects a suction side of the first flow circuit to a pressure side of the second flow circuit.

3. The cooling system as claimed in claim 2, wherein the first flow circuit is provided with a pressure-controlled valve which is arranged to open when a predetermined pressure level is exceeded and which then communicates with the coolant reservoir arranged in the second flow circuit.

4. The cooling system as claimed in claim 3, wherein the coolant reservoir is connected via an inlet line to the circulation pump of the second flow circuit.

5. The cooling system as claimed in claim 4, wherein a line with a pressurized one-way valve permits coolant to flow into the first flow circuit from the coolant reservoir when the cooling system undergoes cooling.

6. The cooling system as claimed in claim 5, wherein the pipeline of the second flow circuit is provided with a variable choke which permits regulation of a pressure drop in the second flow circuit for feeding coolant from the second flow circuit to the first flow circuit.

7. The cooling system as claimed in claim 6, wherein the first flow circuit comprises a cooler for a liquid-cooled retarder.

8. The cooling system as claimed in claim 2, wherein the coolant reservoir is connected via an inlet line to the circulation pump of the second flow circuit.

9. The cooling system as claimed in claim 2, wherein a line with a pressurized one-way valve permits coolant to flow into the first flow circuit from the coolant reservoir when the cooling system undergoes cooling.

10. The cooling system as claimed in claim 2, wherein the pipeline of the second flow circuit is provided with a variable choke which permits regulation of a pressure drop in the second flow circuit for feeding coolant from the second flow circuit to the first flow circuit.

11. The cooling system as claimed in claim 10, wherein the first flow circuit comprises a cooler for a liquid-cooled retarder.

12. The cooling system as claimed in claim 1, wherein the first flow circuit is provided with a pressure-controlled valve which is arranged to open when a predetermined pressure level is exceeded and which then communicates with the coolant reservoir arranged in the second flow circuit.

13. The cooling system as claimed in claim 1, wherein the coolant reservoir is connected via an inlet line to the circulation pump of the second flow circuit.

14. The cooling system as claimed in claim 1, wherein a line with a pressurized one-way valve permits coolant to flow into the first flow circuit from the coolant reservoir when the cooling system undergoes cooling.

15. The cooling system as claimed in claim 1, wherein the pipeline of the second flow circuit is provided with a variable choke which permits regulation of a pressure drop in the second flow circuit for feeding coolant from the second flow circuit to the first flow circuit.

16. The cooling system as claimed in claim 15, wherein the first flow circuit comprises a cooler for a liquid-cooled retarder.

17. The cooling system as claimed in claim 1, wherein the first flow circuit comprises a cooler for a liquid-cooled retarder.

18. The cooling system as claimed in claim 1, wherein the system is configured such that, during normal operation, a pressure rise to a normal operating pressure in the first flow circuit is more rapid than pressure rise to a normal operating pressure in the second flow circuit.

19. The cooling system as claimed in claim 1, wherein the system is configured such that, during normal operation, a normal operating pressure in the first flow circuit is greater than a normal operating pressure in the second flow circuit.

20. The cooling system as claimed in claim 1, wherein the system is configured such that, during normal operation, a normal operating temperature and pressure in the first flow circuit is greater than a normal operating temperature and pressure in the second flow circuit.

* * * * *